US007785153B2

(12) United States Patent
Wang et al.

(10) Patent No.: US 7,785,153 B2
(45) Date of Patent: Aug. 31, 2010

(54) POWER CONNECTOR WITH SEALED INNER BASE MEMBER

(75) Inventors: Chang-Yin Wang, Kunshan (CN); Wei-Ya Cheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 12 days.

(21) Appl. No.: 12/228,761

(22) Filed: Aug. 15, 2008

(65) Prior Publication Data

US 2009/0047840 A1 Feb. 19, 2009

(30) Foreign Application Priority Data

Aug. 15, 2007 (CN) ..... 2007 2 0042908

(51) Int. Cl.
*H01R 24/04* (2006.01)

(52) U.S. Cl. ..... 439/668; 439/685; 439/686

(58) Field of Classification Search ..... 439/682, 439/685, 686, 687, 692, 695, 696
See application file for complete search history.

(56) References Cited

U.S. PATENT DOCUMENTS 4,781,614 A * 11/1988 Ahroni ..... 439/391
4,897,052 A * 1/1990 Priest et al. ..... 439/652
5,647,751 A * 7/1997 Shulman et al. ..... 439/106
6,247,978 B1 * 6/2001 Wu ..... 439/879
6,290,512 B1 * 9/2001 Mullen, Jr. ..... 439/106
2003/0077947 A1 * 4/2003 Sugimori ..... 439/686

FOREIGN PATENT DOCUMENTS

CN 2446564 Y * 9/2001
TW 351497 1/1999
TW 536018 6/2003

* cited by examiner

*Primary Examiner*—Tho D Ta
*Assistant Examiner*—Travis Chambers
(74) *Attorney, Agent, or Firm*—Wei Te Chung; Andrew C. Cheng; Ming Chieh Chang

(57) ABSTRACT

A power connector (100) includes an insulator (2) and a cap (1). The insulator defines a bottom wall and three mounting holes (21, 22 and 23) extending upwards from the bottom wall, the three mounting holes array in a triangle along a vertical surface, and each mounting hole opens forwards and upwards adapted for receiving a terminal (3). The cap is slidably mounted on the insulator, and comprises a plate (14) extending vertically to cover front surfaces of the mounting holes of the insulator and a roof (12 and 13) extending horizontally from an upper end of the plate to cover upper surfaces of the mounting holes. The plate of the cap forms three through-holes (141, 142 and 143) respectively communicating with the corresponding mounting holes and three frames (1411, 1421 and 1431) extending horizontally into the corresponding mounting holes from inner walls of said three through-holes.

16 Claims, 6 Drawing Sheets

POWER CONNECTOR WITH SEALED INNER BASE MEMBER

CROSS-REFERENCE TO RELATED APPLICATIONS

This application is related to a copending U.S. patent application filed on Aug. 15, 2008 and entitled "Power Connector With Two Housing Parts Mounted To Each Other For Holding Contact Terminals Therein", both of which have the same assignee as the present invention.

BACKGROUND OF THE INVENTION

1. Field of the Invention

This invention generally relates to a power connector, and more particularly, to a kind of power connector with a sealed inner base member which is composed of two members.

2. Description of the Prior Art

Power plug connector assemblies are more and more widely used in the connection of various home electric appliances now, thus the manufacturers and researchers have paid more attention to design the power plug connector assembly which are more securely and easily to be manufactured. Generally, the power plug connector assembly has two-pole or three-pole electrical pin therein, and the three-pole power plug connector assembly is more securely in the using process, so the three-pole power plug connector assembly is widely used in the home electric appliances now.

Chinese Patent Issue No. CN 2446564Y disclosed a kind of three-pole power connector, please referring to FIGS. 5-6 in the above mentioned patent, which comprises an inner base member 3 and three terminals 4 held in the inner base portion 3. The inner base member 3 has a pair of upper and lower members 31 and 32 assembled to each other, the lower member 32 defining three cavities 323 for receiving a plurality of terminals 4, the upper member 31 having front and top walls 312 and 311 to abut against and cover cavities 323 of the lower member 32. However, because of manufacturing errors, there may be a gap between the front wall 312 and the cavities 323.

Hence, an improved power connector is desired to overcome the above problem.

BRIEF SUMMARY OF THE INVENTION

It is an object of the present invention to provide a power connector with a sealed inner base member which is composed of two members.

In order to attain the object above, a power connector according to the present invention comprises an insulator and a cap. The insulator defines a bottom wall and three mounting holes extending upwards from the bottom wall, the three mounting holes array in a triangle along a vertical surface, and each mounting hole opens forwards and upwards adapted for receiving a terminal. The cap is slidably mounted on the insulator, and comprises a plate extending vertically to cover front surfaces of the mounting holes of the insulator and a roof extending horizontally from an upper end of the plate to cover upper surfaces of the mounting holes. The plate of the cap forms three through-holes respectively communicating with the corresponding mounting holes and three frames extending horizontally into the corresponding mounting holes from inner walls of said three through-holes.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
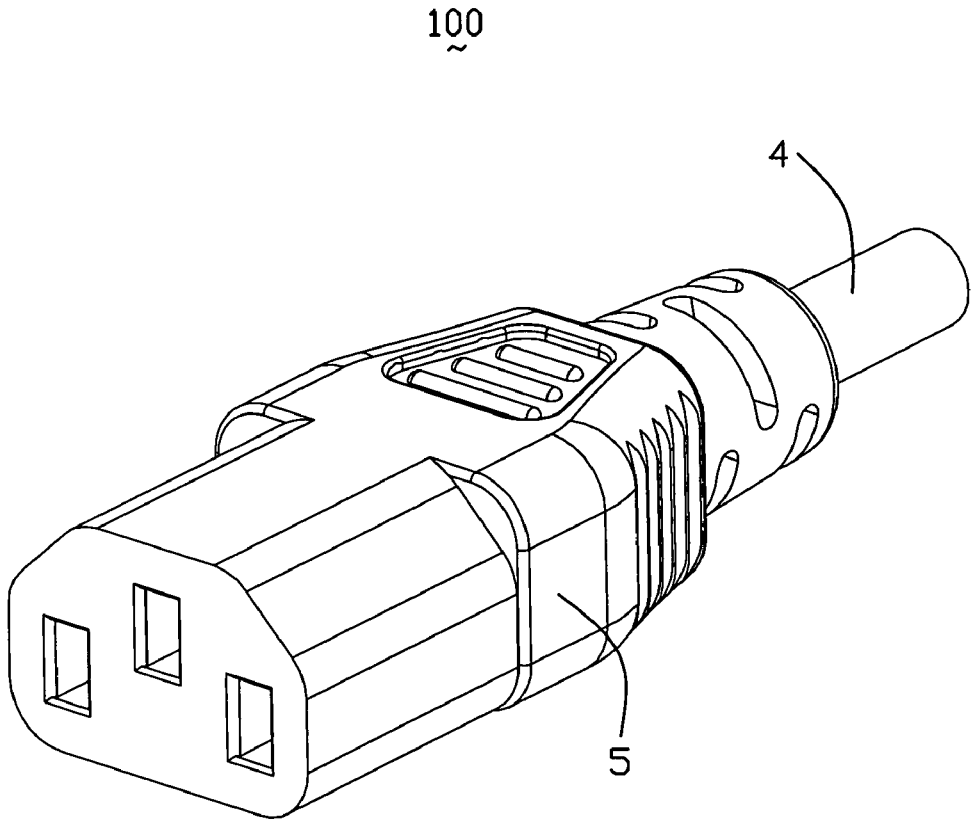
FIG. 1 is an assembled view of a power connector with a cable and a cover thereof in accordance with the present invention.
Figure 2:
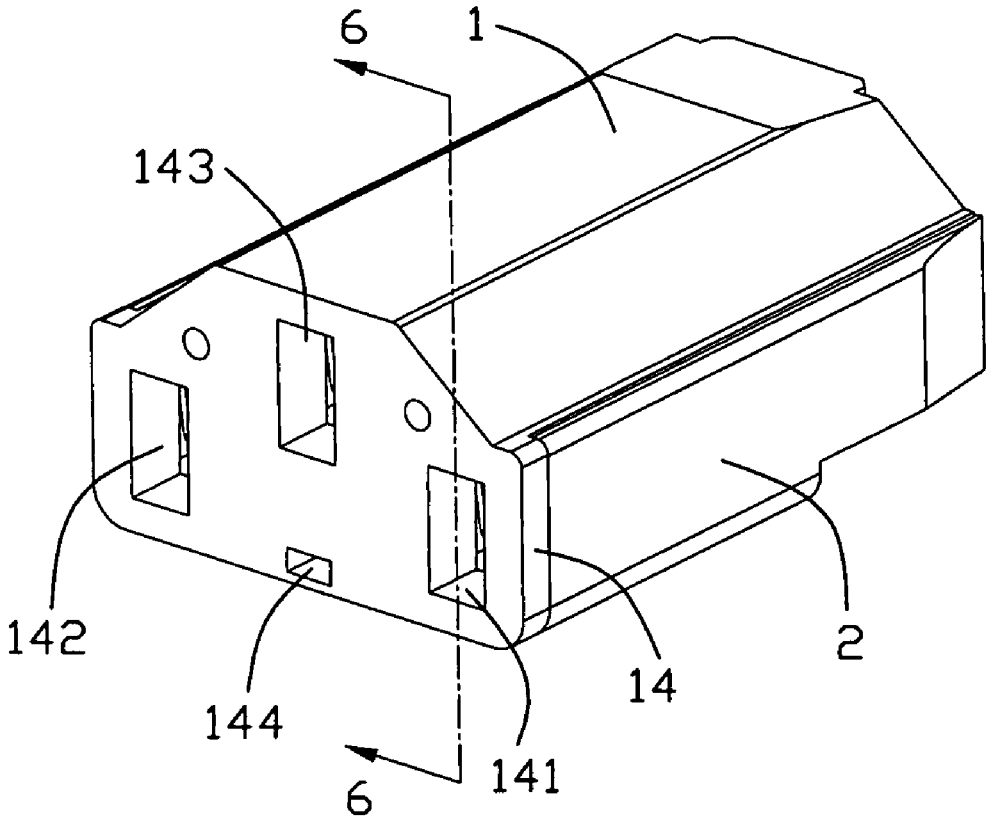
FIG. 2 is an assembled view of a power connector without a cover.

Reference will now be made in detail to the preferred embodiment of the present invention.

Please referring to FIGS. 1-4, a power connector in accordance with the present invention comprises a housing, a plurality of conductive terminals 3 disposed in the housing, a cable 4 electrically connecting with the terminals 3, and a cover 5 molded over the housing and the cable 4. The housing is composed of a first housing 1 and a second housing 2 engaging with each other.

Figure 3:
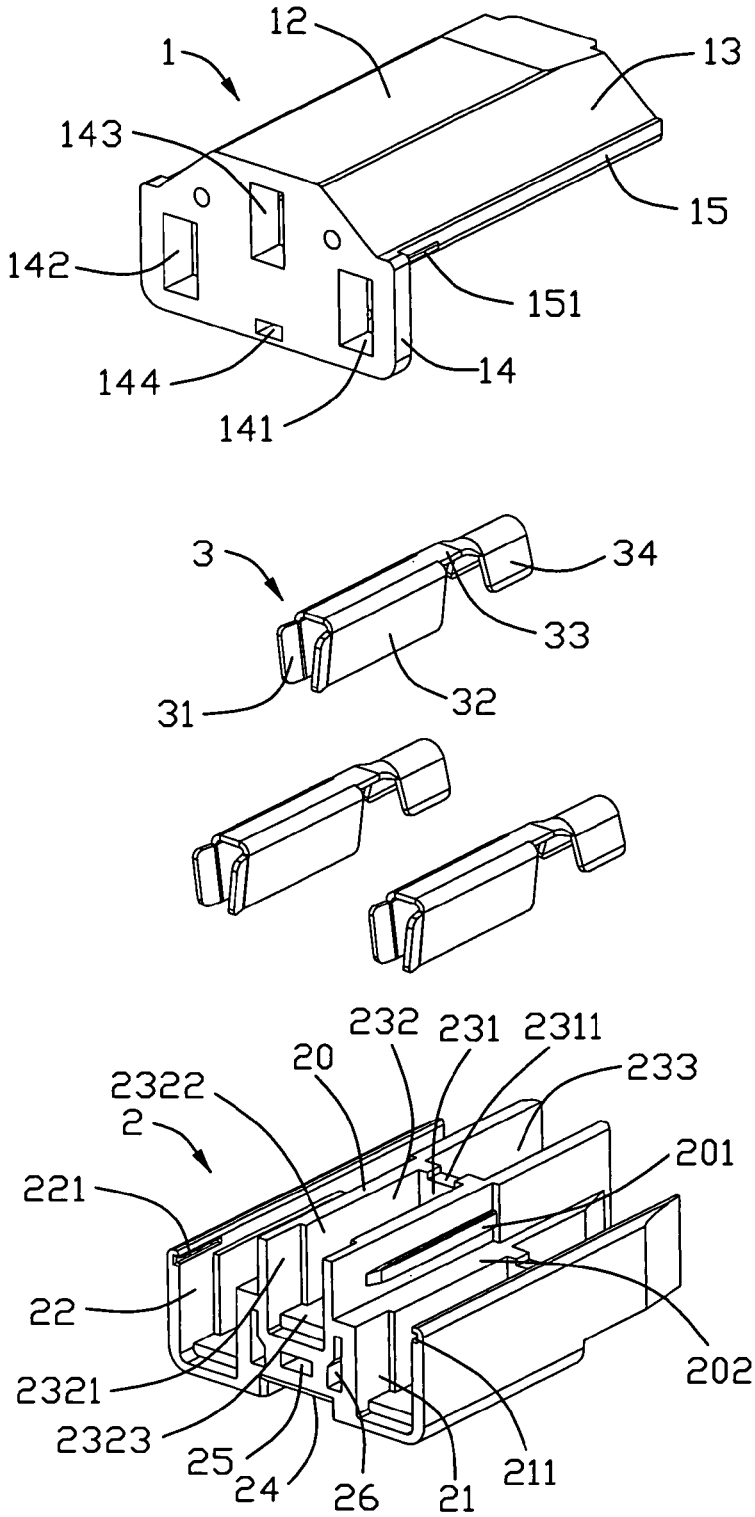
FIG. 3 is an exploded, perspective view of the power connector shown in FIG. 2.
Figure 4:
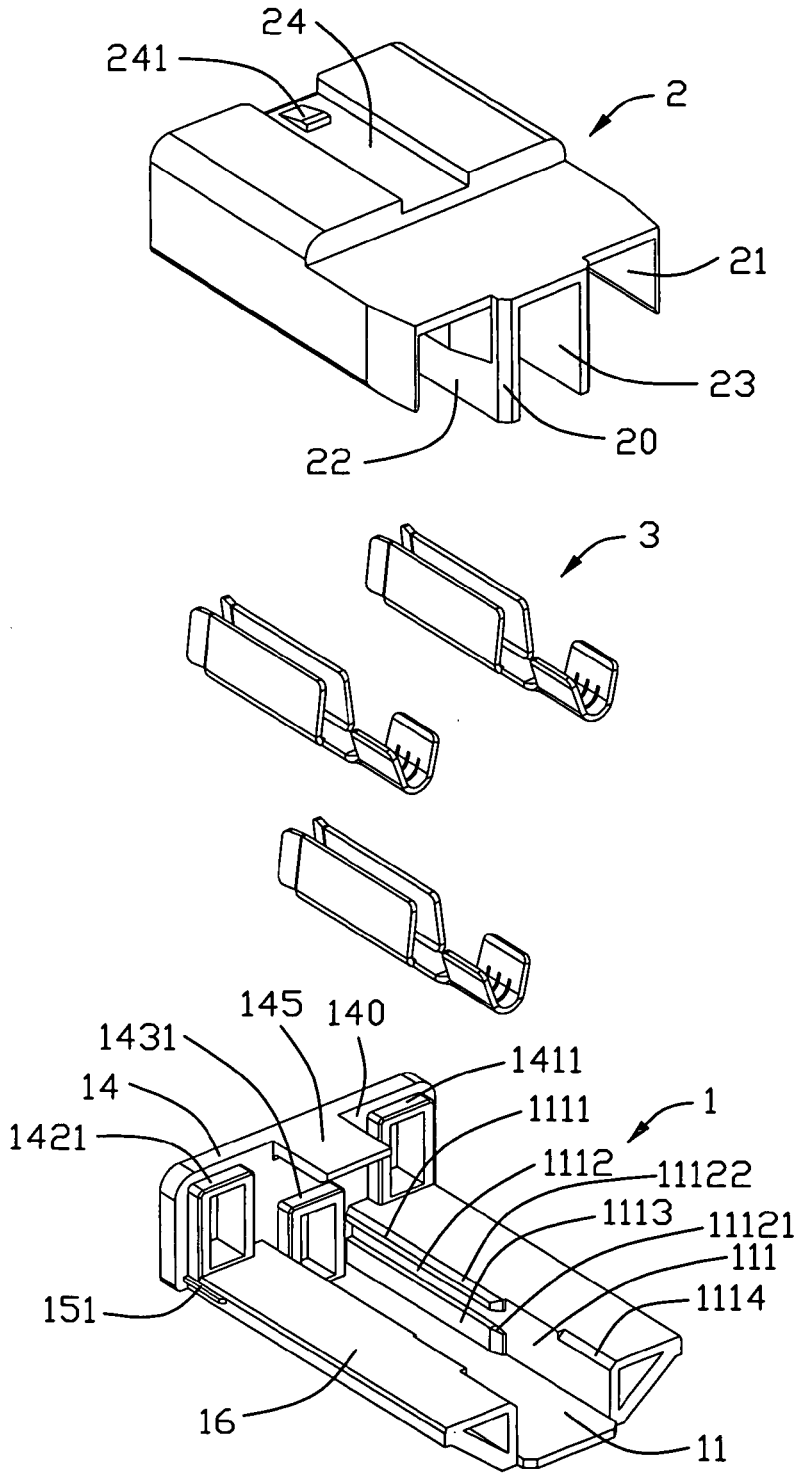
FIG. 4 is a view similar to FIG. 3, but viewed from another aspect.
Figure 5:
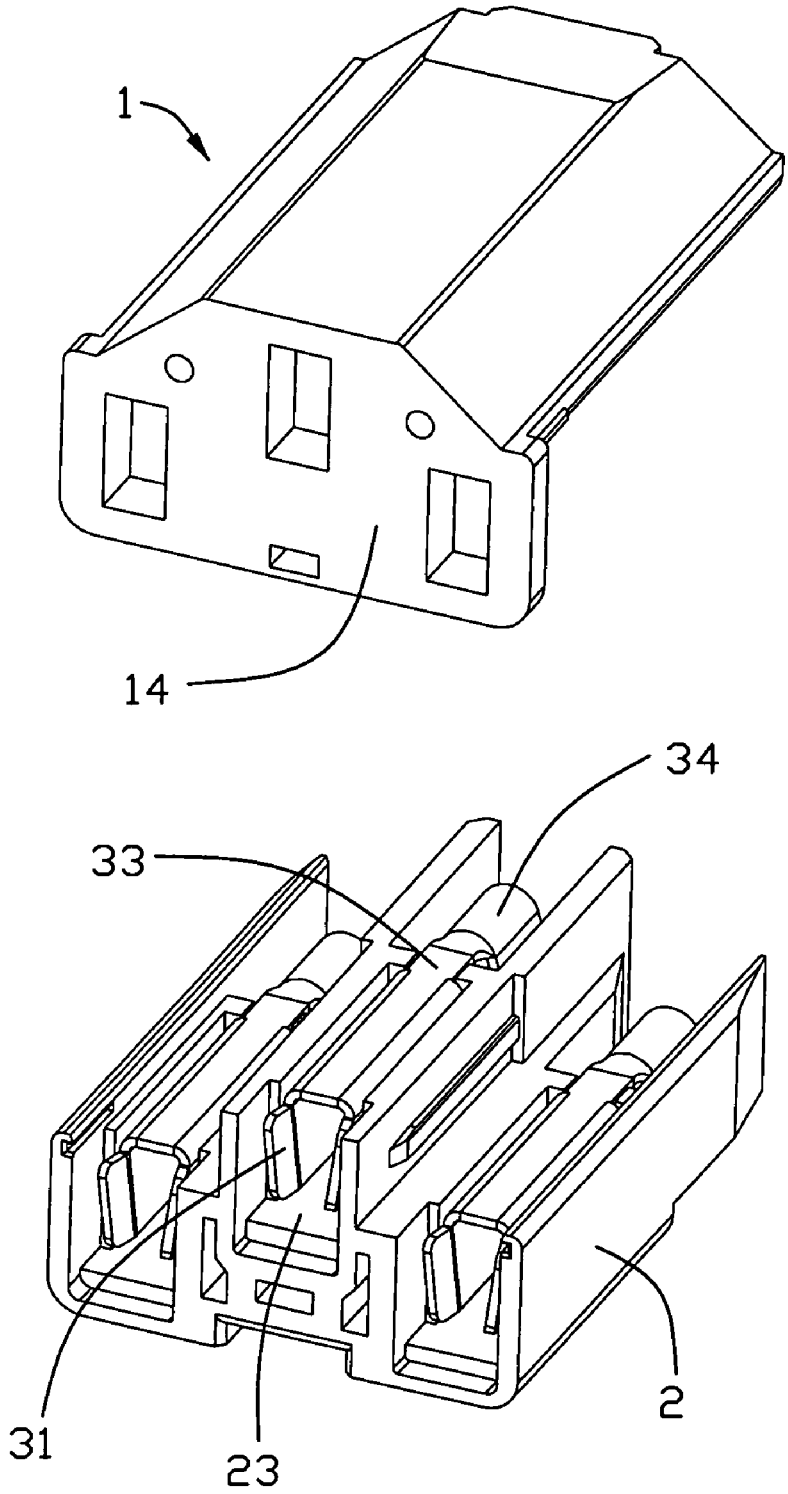
FIG. 5 is a partially assembled view.

Referring to FIGS. 3-4, the first housing 1 has a cross-section of trapezoid, and defines an upper flat surface 12 and a pair of inclined surfaces 13. The first housing 1 configures a groove 11 at the center and a pair of guide slots 1112 in both inner walls 111 of the groove 11. Each guide slot 1112 is defined by a pair of raised bars 1111 and 1113, and the inner wall 111 forms a chamfer 1114 at the rear end. A plate 14 with three rectangular insertion holes 141, 142 and 143 arrayed in a triangle is formed in the front of the first housing 1, the third insertion hole 143 disposed in the center and communicating with the groove 11, the first and second insertion holes 141 and 142 disposed beneath the third insertion hole 143. A hole 144 are formed under the third insertion hole 143 between the first and second insertion holes 141 and 142. The plate 14 has an inner surface 140 with a nose 145 thereon, the nose 145 disposed above the groove 11 and comprising a dent 1451 communicating with the groove 11. A plurality of rectangular frames 1411, 1421 and 1431 protrude from the inner surface 140 of the plate 14 and communicate with the corresponding insertion holes 141, 142 and 143. A pair of engaging portions 15 with a pair of protrusions 151 in the front ends are formed to engage with the second housing 2.

The second housing 2 is separated into first, second and third mounting holes 21, 22 and 23 communicating with the corresponding insertion holes 141, 142 and 143 by a pair of separators 20. A pair of slits 211 and 221 are formed in the front of the first and second mounting holes 21 and 22. A pair of platforms 212 respectively connect the separators 20 to sidewalls of the first and second mounting holes 21 and 22, and stand in a horizontal plane. A pair of guiding posts 201 are formed on outer surfaces of the separator 20. Bottom surface 242 of the second housing 2 has a depression 24 with a wedge 241 thereof at the center, and the front of depression 24 is narrower than the rear. There are a pair of L-shaped gaps 26 and a rectangular opening 25 between the third mounting hole 23 and the depression 24.

A stopper 231 with a nick 2311 thereof lies at the rear end of each mounting hole 21, 22 and 23. The third mounting hole 23 comprises a front cave 232, a rear cave 233 narrower than the front cave 232 and communicating with the front cave 232, and a bottom wall 2323. The first and second mounting holes 21 and 22 have similar constructions to the third mounting hole 23.

The guiding slot 1112 forms a chamfer 11121 at the rear end to lead the guiding post 201 into the guiding slot 1112 and an inclined surface 11122 at the upper end thereof to lead the guiding post 201 into the guiding slot 1112 along a vertical direction. The inclined surface 11122 has a length equal to that of the guiding slot 1112.

The terminal 3 comprises a mating portion 31, a body portion 32 extending backwards from the mating portion 31, a tail 34 adapted for holding a cable, and an engaging portion 33 connecting the body portion 32 and the tail 34.

Please referring to FIGS. 2-5, at first, the terminals 3 with a cable 4 therein are mounted in the corresponding mounting holes 21, 22 and 23 of the second housing 2, with the mating portion 31 and the body portion 32 respectively received in the front and rear caves 2321 and 2322, the engaging portion 33 disposed in the nick 2311 of the stopper 231, and the tail 34 with the cable 4 received in the cavity 233. Secondly, the rear portion of the first housing 1 is placed on the front portion of the second housing 2, with the bottom surface 16 of the first housing 1 abutting against the platforms 202 of the second housing 2 and the guiding posts 201 of the second housing 2 inserted into the guide slots 1112 of the first housing 1. In this process, the chamfer 1114 of the first housing 1 is helpful for the first housing 1 to enter the second housing 2 along a vertical direction. The engaging portions 15 of the first housing 1 engage with outer sidewalls of the first and second mounting holes 21 and 22. Thirdly, the guiding posts 201 slide forwards along the guide slots 1112 till the first and second housings 1 and 2 are completely assembled. At the same time, the nose 145 of the first housing 1 is inserted into the depression 24 of the second housing 2 and engages with the wedge 241 of the depression 24.

Figure 6:
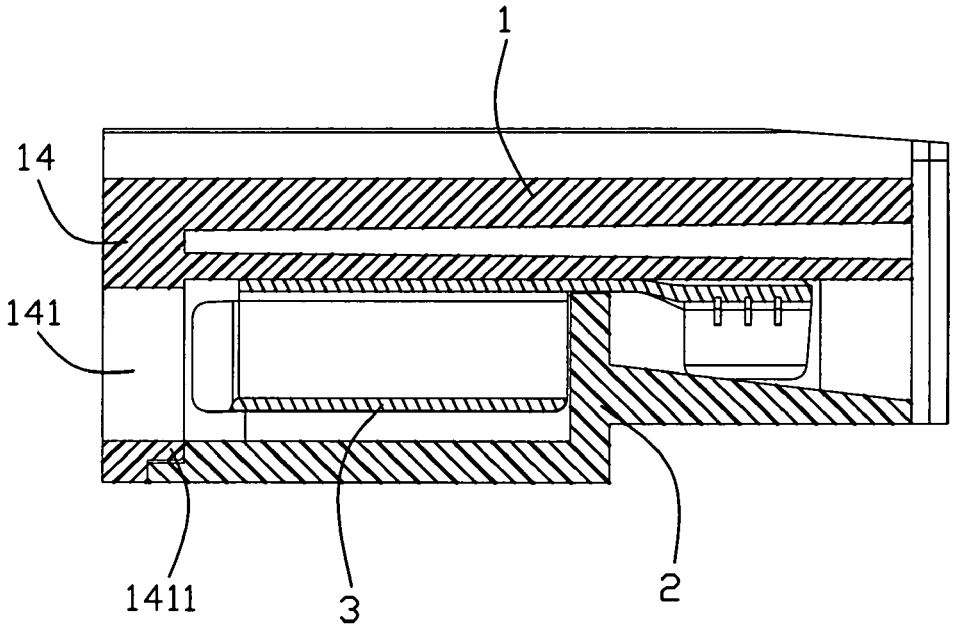
FIG. 6 is a cross-sectional view of FIG. 2 taken along line 6-6.

Please referring to FIG. 6, after the first and second housing 1 and 2 are mounted to each other, the frames 1411, 1421 and 1431 are inserted into the first, second and third mounting holes 21, 22 and 23, so there is not any gap between the mounting holes 21, 22 and 23 and the plate 14. Finally, a cover 5 is molded over the housing and the cable 4.

When it is needed to disassemble the first and second housings 1 and 2, a tool (not shown) is inserted into the hole 144 and raises the nose 145. Therefore, the locking of the nose 145 and the wedge is relieved.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A power connector, comprising:

an insulator defining a bottom wall and three mounting holes extending upwards from the bottom wall, the three mounting holes arraying in a triangle along a vertical direction, each mounting hole opening forwards and upwards adapted for receiving a terminal; and a cap slidably mounted on the insulator, the cap comprising a plate extending vertically to cover front surfaces of the mounting holes of the insulator and a roof extending horizontally from an upper end of the plate to cover upper surfaces of the mounting holes, said plate of the cap forming three through-holes respectively communicating with the corresponding mounting holes and three rectangular frames extending from an inner surface of the plate horizontally into the corresponding mounting holes, and one of the frames located in a groove of the cap.

2. The power connector as recited in claim 1, wherein inner walls of the frame stand in the same surface to the corresponding inner walls of the through-hole.

3. The power connector as recited in claim 1, wherein a guide slot is formed integrally with the cap, and a guiding post is formed integrally with the insulator to engage with said guide slot.

4. The power connector as claimed in claim 1, wherein said cap is constantly attached to the insulator.

5. The power connector as recited in claim 1, wherein a wedge is formed on the bottom wall of the insulator, and a nose with a dent depressed therein extends horizontally from an lower end of said plate adapted for engaging with said wedge.

6. The power connector as recited in claim 5, wherein a depression is depressed in the bottom wall of the insulator, and the wedge is formed in said depression.

7. The power connector as recited in claim 6, wherein the wedge forms an inclined surface at its front end to guide the nose.

8. The power connector as recited in claim 5, wherein said dent of the nose forwards extends through said plate of the cap to facilitate the formation of said dent when the cap is formed.

9. The power connector as recited in claim 8, wherein a depression is depressed in the bottom wall of the insulator, and the wedge is formed in said depression.

10. The power connector as recited in claim 8, wherein a guide slot is formed integrally with the cap, and a guiding post is formed integrally with the insulator to engage with said guide slot.

11. A power connector, comprising:

an insulator defining a bottom wall and three mounting holes extending upwards from the bottom wall, the three mounting holes arraying in a triangle along a vertical surface, each mounting hole opening forwards and upwards adapted for receiving a terminal; and a cap slidably mounted on the insulator, the cap comprising a plate extending vertically to cover front surfaces of the mounting holes of the insulator and a roof extending horizontally from an upper end of the plate to cover upper surfaces of the mounting holes, the plate having three rectangular frames extending into corresponding mounting holes to prevent melted material from entering into the insulator along a direction perpendicular to an inserting direction;

wherein one of the insulator and the cap forms a guide slots extending horizontally, the other one of the insulator and the cap forms a guiding post extending horizontally to engage with the guiding slot, the guiding slot forms a chamfer at the rear end to lead the guiding post in the guiding slot and an inclined surface at the upper end thereof to lead the guiding post.

12. The power connector as recited in claim 11, wherein the inclined surface has a length equal to that of the guiding slot.

13. The power connector as recited in claim 11, wherein a wedge is formed on the bottom wall of the insulator, and a nose with a dent depressed therein extends horizontally from a lower end of said plate adapted for engaging with said wedge.

14. The power connector as claimed in claim 11, wherein said cap is constantly attached to the insulator.

15. A power connector comprising:

an insulator defining three mounting holes extending along a front-to-back direction through a front surface thereof, each of said mounting hole essentially being of a four-sided rectangular cross-section with three side walls surrounded on three sides thereof with one side remaining open;

a plurality of terminals respectively received in the corresponding mounting holes, respectively; and a cap slidably mounted on the insulator and covering said one side of each of the mounting holes, said cap further comprising a plate covering front surface, said plate of the cap forming three through holes respectively aligned and communicating with the three corresponding mounting holes; wherein each of said through holes is equipped with a four sided frame on an inner surface of the plate under a condition that three sides of the frame laterally confront three corresponding sides of the insulator, and a remaining one side of the frame laterally confronts a corresponding side of the cap.

16. The power connector as claimed in claim 15 wherein said cap is constantly attached to the insulator.

* * * * *